US008816894B1

(12) United States Patent
Apgar et al.

(10) Patent No.: US 8,816,894 B1
(45) Date of Patent: Aug. 26, 2014

(54) FLOATING RADAR DECOY WITH RADAR "IMAGE" THAT MATCHES THE IMAGE OF THE PROTECTED SHIP

(75) Inventors: Brian P. Apgar, Mt. Laurel, NJ (US); Matthew T. Woitowicz, Jr., Moorestown, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 533 days.

(21) Appl. No.: 12/715,955

(22) Filed: Mar. 2, 2010

(51) Int. Cl.
*H01Q 15/20* (2006.01)
*F41J 2/00* (2006.01)

(52) U.S. Cl.
CPC .. *H01Q 15/20* (2013.01); *F41J 2/00* (2013.01)
USPC ..... 342/10; 342/8

(58) Field of Classification Search
USPC ..... 342/7, 9, 10
See application file for complete search history.

(56) References Cited

U.S. PATENT DOCUMENTS

| | | | | | |
|---|---|---|---|---|---|
| 2,450,551 | A | * | 10/1948 | Harrington, Jr. | 89/134 |
| 3,039,093 | A | * | 6/1962 | Rockwood | 342/7 |
| 3,115,631 | A | * | 12/1963 | Martin | 342/8 |
| 4,096,479 | A | * | 6/1978 | Van Buskirk | 342/7 |
| 4,551,726 | A | * | 11/1985 | Berg | 342/7 |
| 4,695,841 | A | * | 9/1987 | Billard | 342/8 |
| H679 | H | * | 9/1989 | Czajkowski, Jr. | 342/13 |
| H694 | H | * | 10/1989 | Czajkowski, Jr. | 342/13 |
| 4,891,649 | A | * | 1/1990 | Labaar et al. | 342/203 |
| 5,122,400 | A | * | 6/1992 | Stewart | 428/34.7 |
| 5,680,136 | A | * | 10/1997 | Chekroun | 342/6 |
| 5,786,786 | A | * | 7/1998 | Small | 342/13 |
| 5,814,754 | A | * | 9/1998 | Mangolds | 89/1.11 |
| 6,429,800 | B1 | * | 8/2002 | Richmond | 342/14 |
| 7,053,812 | B2 | * | 5/2006 | Trainor | 342/14 |
| 7,333,050 | B2 | * | 2/2008 | Svy et al. | 342/169 |
| 2007/0108345 | A1 | * | 5/2007 | McDonnell | 244/110 C |

* cited by examiner

*Primary Examiner* — Matthew M Barker
(74) *Attorney, Agent, or Firm* — Howard IP Law Group, PC

(57) ABSTRACT

A ship having identifiable radar hot spots along its length is protected against radar homing missile attack by a floating decoy, which may be towed. The decoy has a plurality of radar return signal generators spaced along its length, with the amplitudes and spacing of the generators emulating the amplitudes and spacing of the hot spots. The homing missile is seduced away from the ship and toward the decoy.

28 Claims, 4 Drawing Sheets

FLOATING RADAR DECOY WITH RADAR "IMAGE" THAT MATCHES THE IMAGE OF THE PROTECTED SHIP

BACKGROUND

Current trends in anti-ship missile seekers include the use of remote identification of the ship as a target. This remote identification may be performed by radar or infrared imaging by sensors and processing on the missile itself. Ship defenses against such missiles include radar-directed defensive gunfire and anti-missile missiles, and also include various forms of concealment and seduction. Concealment includes use of a chaff cloud or smokescreen to mask or hide the ship. Seduction involves giving the missile seeker a more attractive target to focus on so that it ignores the ship and includes ejection of alternative targets such as decoys, as well as the use of electronic attack.

Some prior-art anti-ship missiles use simple infrared or radar homing seekers, which home on the largest-amplitude target in the sensor field of view. A simple countermeasure for such missiles is the use of decoys in the form of flares or chaff launched from the ship being defended, to provide a singular "hot spot" to seduce the missile seeker away from the ship.

More sophisticated missile seekers include infrared imaging sensors and advanced signal processing to resolve and home on a ship's distributed signature profile. These seekers tend to be immune to seduction by simple hot spot flares, and may be programmed to reject as a target any "ship" return which has non-ship motion, such as excessive acceleration or upward motion which might be associated with a flare launch.

Improved or alternative decoys are desired.

SUMMARY

A ship decoy according to an aspect of the disclosure comprises a plurality of radar return generators, each of which radar return generators is structurally attached to the next with a nominally fixed separation by a nominally rigid member. The radar return generators may be an active repeating device or passive radar reflector, and such a passive device may include a plurality of trihedral corner reflectors, which may be subsumed within an inflatable icosahedral structure. The nominally rigid member may comprise an inflatable tube affixed to each of the radar return generators and extending to the next adjacent radar return generator to thereby define a string of radar return generators. The decoy may be used with a ship having a particular spatial distribution of significant radar scattering locations along its length, wherein the location in the decoy of each one of the radar return generators corresponds to the relative position of one of the significant scattering locations, and the fixed separation between each of the return generators and the next corresponds to the separation between the corresponding ones of the scattering locations. Each radar return generator may exhibit amplitude relative to others of the radar return generators, which amplitude corresponds with the relative amplitude of corresponding ones of the significant scattering locations of the ship. In a particularly advantageous embodiment, a decoy for use with a ship having a particular amplitude distribution of significant radar scattering locations along its length, has location and reflection amplitude of each one of the radar return generators corresponding to the relative position and amplitude of one of the significant radar scattering locations, and the fixed separation between each of the return generators and the next return generator corresponds to the separation between the corresponding ones of the scattering locations of the ship. In a particularly advantageous embodiment according to an aspect of the disclosure, the combination of the radar return generators and the nominally rigid member is lighter than water. This is easily accomplished if both the nominally rigid members and the radar return generators are both lightweight inflatable structures.

According to another aspect of the disclosure, a floating decoy is for a ship having a particular distribution of significant radar scattering locations along its length, which significant scattering locations are spaced apart by known distances. The floating decoy comprises a plurality of significant radar scattering devices. The floating decoy also comprises at least one elongated, nominally rigid member extending between mutually adjacent ones of the radar scattering devices. The length of each member is selected in conjunction with the dimensions of the significant radar scattering devices such that the nominal distance between adjacent ones of the locations equals the separation between adjacent corresponding ones of the scattering locations. In a particular embodiment, the nominally rigid member is in the form of a tube, and the tube may be an inflatable tube. Each of the significant radar scattering devices may comprise a cluster of simple radar reflectors. In a preferred embodiment, the particular distribution of significant radar scattering locations along the length of the ship is accompanied by a distribution of the reflection amplitudes of the radar scattering devices, and the spatial distribution of reflection amplitudes of the radar scattering devices is correlated with the spatial distribution of the significant radar scattering locations.

A floating decoy for a ship having a particular distribution of at least first and second significant radar hot spots at locations spaced by a particular distance along its length, where the hot spots have mutually different amplitudes. The decoy comprises first and second radar return devices, with the first radar return device exhibiting a radar return amplitude related to the amplitude of the first one of the hot spots and the second radar return device exhibiting a radar return amplitude related to the amplitude of the second one of the hot spots. The decoy also comprises at least one elongated nominally rigid member extending between the first and second radar return devices. The length of the nominally rigid member(s) and any combination of intervening radar return devices and members being nominally equal to the particular distance.

A decoy for a ship having a particular distribution of at least first and second significant radar return locations spaced by a particular distance along its length, the return locations having nominally the same return amplitudes. The decoy comprises first and second inflatable significant radar return devices, both of which exhibit the same return amplitudes. The decoy also comprises at least one elongated inflatable tube extending between the first and second radar return devices, the length of the inflatable tube and any intervening radar return devices being nominally equal to the particular distance.

A floating decoy for seducing a radar homing missile toward the decoy and away from a ship to be protected, the ship to be protected defining a particular distribution of at least first and second radar reflection scattering centers, where the distribution of the first and second scattering centers implicates both scattering centers relative amplitude and hot spot relative locations along the length of the ship, the decoy comprising:

at least first and second radar return generators exhibiting a spatial and amplitude distribution corresponding to that of the first and second shipboard scattering centers.

A method for using a floating decoy for seducing a radar homing missile toward the decoy and away from a ship to be protected, where the ship to be protected defines a particular amplitude and spatial distribution of at least first and second radar reflection hot spots, where the first reflection hot spot is at a location more forward than the second radar reflection hot spot, where the decoy comprises first and second radar return generators having the particular amplitude and spatial distribution, the method comprising the step of:

towing the floating decoy with the first radar return generator forward of the second radar return generator.

DETAILED DESCRIPTION

It is anticipated that advanced radar-based antiship missile seekers may include sensors and processing capable of determining the physical characteristics of a putative target. These physical characteristics may include length and the locations along that length of significant radar scatterers. Such significant scatterers may be viewed as being radar cross-section (RCS) "hot spots" along the length of the target. Such processing may even extend to differentiation among the hot spots in terms of radar cross-section amplitude.

In order to seduce such a sophisticated seeker, a decoy must reflect or return radar signals of sufficient quantity, magnitude and spacing so as to emulate the return from an actual ship. According to an aspect of the disclosure, a ship decoy comprises an elongated floating structure which bears return signal generators, either active or passive, along its length in a pattern selected to emulate the pattern of the hot spots of the ship being protected.

Figure 1A:
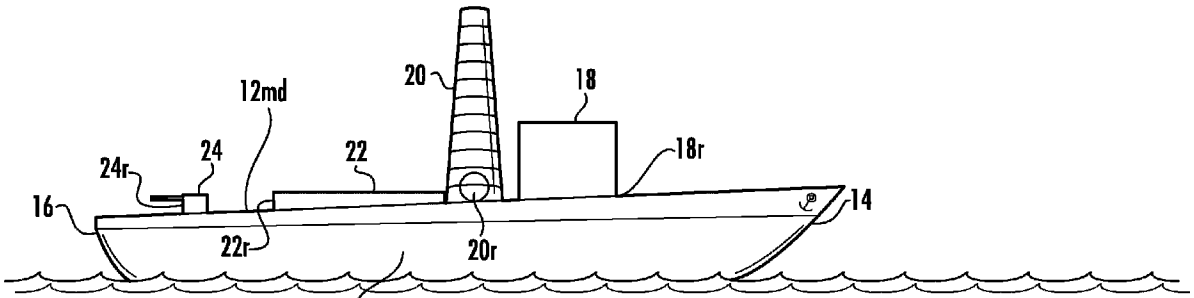
FIG. 1A is a simplified side view of a ship that is to be protected by a floating decoy.
Figure 1B:
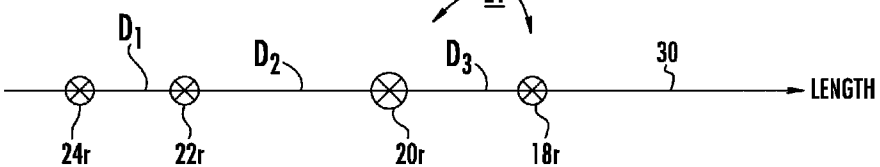
FIG. 1B is a representation of the spatial distribution of radar scattering centers along the ship of FIG. 1A.

FIG. 1A is a simplified side outline of an exemplary embodiment of a ship 10 from which it might be required to seduce away a homing antiship missile. In FIG. 1A, the hull of ship 10 is designated 12, the bow is 14, and the stern is 16. The ship's hull bears structures extending above the main deck 12*md*. The illustrated structures represent a deckhouse 18, mast 20, engine room 22, and gun 24. These structures will reflect electromagnetic or radar signals in an amount which depends upon their shapes and on the angles which are presented to the radar signal. While the entire structure will reflect signals to some degree, certain "hot spots" may manifest themselves, and their locations can be determined by analysis or by tests on a model of the ship or on the ship itself. These hot spots exhibit greater reflections than the average scatterers of the ship, so that they stand out on a display of radar return. For purposes of explanation, it is assumed that the hot spots in the arrangement of FIG. 1 appear at a location 18*r*, which is the junction of the deckhouse 18 with the main deck 12*md*, at a location 20*r*, which is centered within the structure of the mast 20 with the main deck 12*md*, a reflection 24*r* at the gun 24 and at a location 22*r* at the rear of the superstructure 22. Also, assume that the hot spot 20*r* at location 20 has an amplitude which is 3 dB greater than that of the other hot spots. This gives a distribution of hot spots similar to that of FIG. 1B. In FIG. 1B, the hot spots 22*r*, 24*r*, 20*r*, and 18*r* are designated together as 21. The spacing of the hot spots 22*r*, 24*r*, 20*r*, and 18*r* along a length line 30 nominally corresponds to the spacings between and among the hot spots of ship 10 of FIG. 1A. In FIG. 1B, the size of the circle representing hot spot 20*r* is larger than the circles representing hot spots 22*r*, 24*r*, and 18*r*, thereby indicating the 3 dB amplitude difference. Hot spots 24*r* and 22*r* are separated by a distance designated D1, hot spots 22*r* and 20*r* are separated by a distance designated D2, and hot spots 20*r* and 18*r* are separated by a distance designated D3. It is assumed that a radar homing missile with a sophisticated seeker may be able to form an "image" of the ship and match it with an internal library image to thereby "positively" type the target on which it is homing. Such a homing missile would presumably be programmable to aim for specific target ship types and ignore other ship types.

In order to seduce such an advanced radar missile seeker, a decoy must provide a pattern of hot spots matching the pattern for which the missile is programmed. Launching and/or towing of such a decoy, in conjunction with maneuvering and other countermeasures, may allow the ship to avoid being struck by the missile. Such other countermeasures might include a chaff screen to mask the ship's signature or electronic jamming to confuse the missile's seeker.

Figure 2:
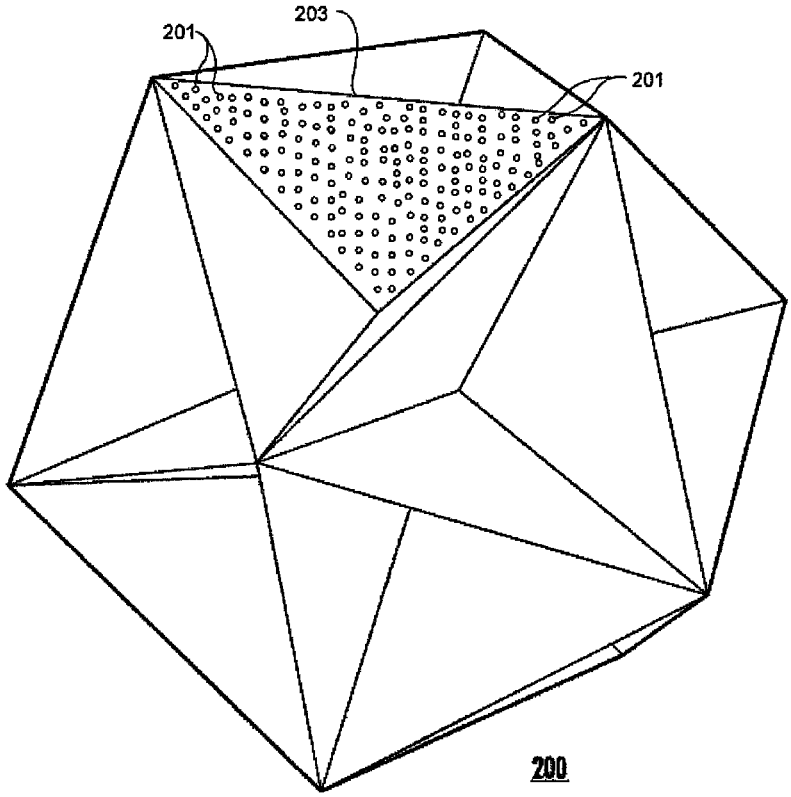
FIG. 2 is a perspective or isometric view of a radar reflector cluster in the shape of an icosahedron.

Radar return signal generators are well known. These return signal generators include passive reflectors and active repeaters. Either may be used with a decoy according to an aspect of the disclosure. Three-sided "corner reflectors" or "trihedrals" have long been known to reflect energy, including light and radio waves, directly back to the source along the path of incidence. The trihedral corner reflector has a limited coverage sector that is approximately 85° in angular extend, within this "preferred" sector, the trihedral shape returns a majority of the energy back to the source. Since the reflected signal preferentially returns along the path of incidence, the reflected signal is stronger than if the reflection were isotropic or random. The use of multiple corner reflectors in a polyhedral structure provides full spherical coverage where energy from any source around the polyhedral structure hits at least one trihedral from its preferred sector. FIG. 2 illustrates twenty corner reflectors assembled into the shape of an icosahedron 200. Such reflectors are well known.

The relative amplitude of the return from a cluster of "corner reflectors" can be adjusted by controlling the size of each constituent corner reflector. This means that a given diameter polyhedron will have a stronger reflection than a smaller-diameter polyhedron. Other options are available to tailor the relative amplitude of a corner reflector to have a smaller response, such as: having non-conductive regions in the trihedral structure or using materials in the trihedral that are less conductive. Thus, regulating the size and/or construction of the cluster of corner reflectors makes it possible to tailor the amplitude to correspond to the relative amplitudes of the hot spots of the ship.

Figure 3A:
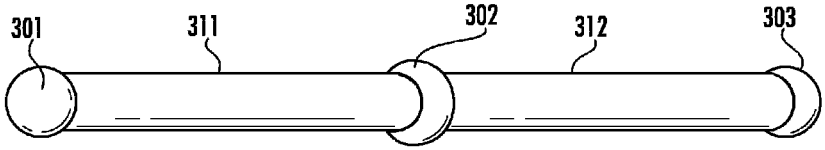
FIGS. 3A, 3B, and 3C are simplified representations of a set of three radar return clusters held separated by structures having one, two, and three elongated elements, respectively.

FIG. 3A is a simplified representation of a decoy according to an aspect of the disclosure. In FIG. 3A, decoy 310 includes first and second relatively small spheres 301, 303 and a relatively large sphere 302, held separated by first and second nominally rigid structures, which, according to an aspect of the disclosure, are inflatable tubes 311 and 312, respectively. The spheres 301 and 303 represent icosahedral (or other polyhedral) reflector clusters, and sphere 302 represents a larger reflector cluster, which reflects more electromagnetic or radar energy than clusters 301 or 303. As an alternative, the various spheres 301, 302, and 303 may represent active radar return generators, or a mix of active radar return generators and passive reflectors. Ideally, the difference in RCS amplitude follows the distribution of reflected energy of the ship to be protected, and is illustrated, for example, in FIG. 1B. The inflatable tubes 311 and 312 of FIG. 3 are not, strictly speaking, rigid, but are nominally rigid, which is to say they are of sufficient rigidity when inflated to tend to maintain the relative separation of the radar return generators clusters under most sea conditions. It will be apparent that two inflatable tubes 311 and 312 suffice to space apart three radar return generators clusters 301, 302, and 303, and more generally N inflatable tubes suffice to space N+1 radar return generators clusters. Ideally, the combination of nominally rigid tubes and radar return generators clusters is buoyant. This can mean that the tubes provide the buoyancy required for both the tubes and the radar return generators clusters, or the radar return generators clusters are sufficiently buoyant to support the tubes.

The cluster of corner reflectors can be implemented as a flexible and inflatable vinyl or other plastic or fabric structure in the general shape of a sphere, with internal flexible metalized septa 203 to define the various trihedral reflectors (as shown in FIG. 2). To allow for fast inflation, substantial apertures (201, shown in FIG. 2) through and around the septa should be provided. Those skilled in the art know that providing apertures through the metalized septa need not reduce the reflectivity if the apertures 201 are small with respect to wavelength, so that the circumference of each aperture is less than about 1/10 wavelength in circumference. Thus, thousands of microscopic apertures may be drilled, as by a laser, through the septa to provide sufficient area for quick air flow during inflation with little or no reduction in the corner reflection.

Figure 3B:
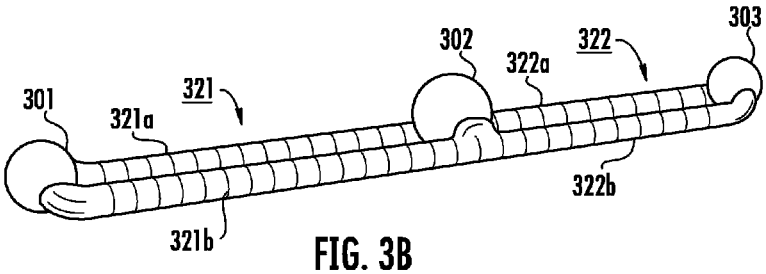
Figure 3C:
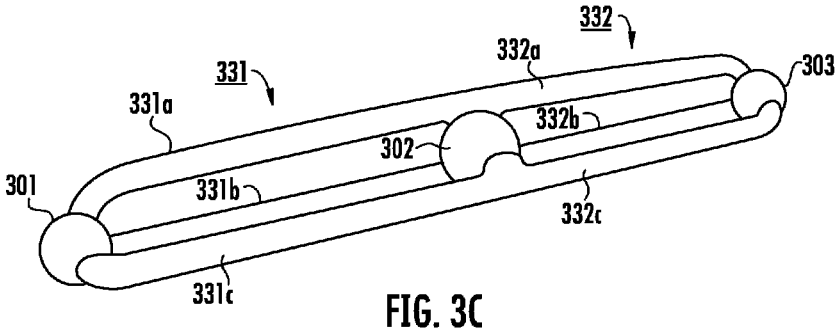

FIG. 3B illustrates another possible nominally rigid structure for holding three radar return generators clusters (that is, clusters of active radar return signal generators or passive radar reflectors) at fixed separations. In FIG. 3B, nominally rigid structures 321 and 322 include or comprise pairs of inflatable tubes. More particularly, nominally rigid structure 321 includes inflatable tubes 321*a* and 321*b*, which run nominally parallel between radar return generators clusters 301 and 302, and nominally rigid structure 322 includes inflatable tubes 322*a* and 322*b*, which run nominally parallel between radar return generators clusters 302 and 303. Each tube connects to a radar return generator cluster by means of a stub appendage (not separately designated). Similarly, FIG. 3C illustrates other possible nominally rigid structures 331 and 332 for holding radar return generators clusters 301, 302, and 303 at nominally fixed separations. In FIG. 3C, nominally rigid structure 331 includes inflatable tubes 331*a*, 331*b*, and 331*c*, which run nominally parallel between the radar return generator clusters 301 and 302, and nominally rigid structure 332 includes inflatable tubes 332*a*, 332*b*, and 332*c*, which run nominally parallel between the radar return generator clusters 302 and 303. The arrangements of FIG. 3B is advantageous in that the decoy system should be more resistant to roll as a function of wave action and has a defined upward direction as opposed to the arrangement of FIG. 3A. The arrangement of FIG. 3C is advantageous in that it should be more rigid and resistant to roll as a function of wave action than the arrangement of FIG. 3A.

Figure 4:
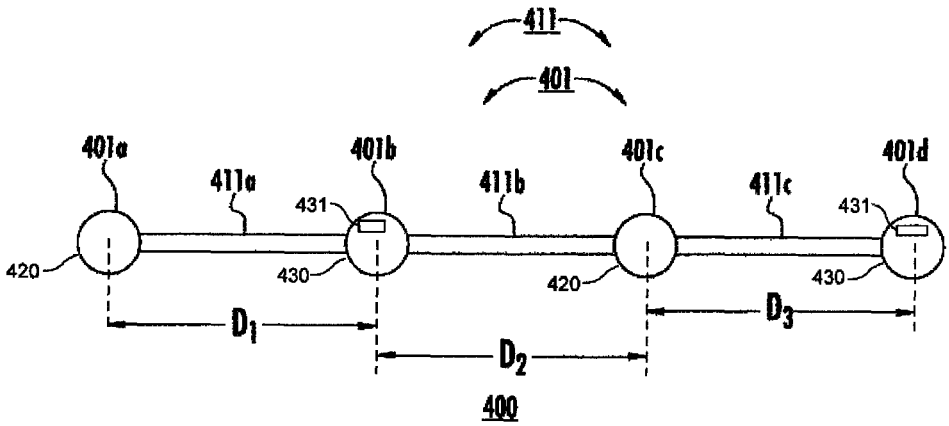
FIG. 4 is a representation of floating decoy with radar return clusters located and of amplitude similar to the locations and amplitude of the radar scattering centers of the ship of FIG. 1A.

FIG. 4 is a representation of a lighter-than-water decoy 400 of the same general sort as those of FIGS. 3A, 3B, and 3C, but with a set 401 of four radar return generators clusters 401*a*, 401*b*, 401*c*, and 401*d* selected in reflection amplitude and inter-cluster spacing to correspond to the ship pattern of FIG. 1B. More particularly, cluster 401*a* is separated from cluster 401*b* by a nominally rigid structure 411*a* that separates the centers of the clusters by distance D1. Cluster 401*b* is separated from cluster 401*c* by a structure 411*b* that separates the centers of the clusters by distance D2. Cluster 401*d* is separated from cluster 401*c* by a structure 411*c* that separates the centers of the clusters by distance D3. This fulfils one aspect of the emulation of the reflection distribution associated with FIGS. 1A and 1B. In addition, radar return generator cluster 401*c* is larger than clusters 401*a*, 401*b*, or 401*d* by an amount sufficient to provide 3 dB more reflected signal or power. This fulfils another aspect of the emulation of the reflection distribution associated with FIGS. 1A and 1B. Naturally, the nominally-rigid inter-cluster structures 411*a*, 411*b*, and 411*c* may have single inflatable tubes, or two or three tubes as described in conjunction with FIG. 3A, 3B, or 3C, or they may have other rigid or nominally rigid structures.

It should be noted that, since the radar return clusters have finite dimensions, the lengths of the inter-cluster nominally-rigid tubes may not precisely match the distances between mutually adjacent hot spots. In general, the lengths of the tubes will be shorter than the center-to-center distance between the hot spots by the diameter of one of the clusters. If the adjacent clusters are not of the same size, the lengths of the separation tube will be the spacing between the hot spots, minus half the diameter of one of the clusters, and minus half the diameter of the other cluster.

The rigid or nominally-rigid separation structures may be made from radar-reflective material or from nonreflective material.

The lighter-than-water aspect of the arrangements of FIG. 2, 3A, 3B, 3C, or 4 can be achieved by assuring that the combination of the flotation provided by the inter-cluster nominally-rigid tubes and the radar return generator clusters themselves has positive buoyancy. This can be guaranteed by assuring that both the inter-cluster nominally-rigid tubes and the radar return generators clusters themselves have positive buoyancy.

The radar return generators may include clusters of active components 430 together with their power supplies 431 and/or clusters of passive reflectors 420.

Figure 5:
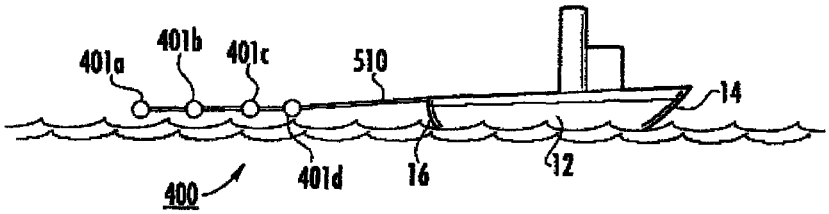
FIG. 5 illustrates the ship of FIG. 1A with a tow line connecting its stern to a floating decoy.

Making the amplitude and spatial distribution of the radar return generators of a decoy match the corresponding amplitude and spatial distribution of the ship being protected may help to seduce a radar homing missile seeker away from the ship. Sophisticated processing by the missile's seeker might reject a "matching" amplitude and spatial distribution if the direction of motion of the ship represented by the decoy is "wrong." That is, taking as an example the decoy return signal distribution of FIG. 4, the seeker might "accept" the decoy distribution if the direction of decoy motion were with radar return generator 401*d* leading the other radar return generators, as though the decoy were moving in a normal "forward" direction, but might "reject' the decoy distribution if the direction of motion of the decoy were with radar return generator 401*a* leading, because this would represent reverse-direction motion, which is not usual. For this reason, the decoy, if it is to be towed, should be towed by the "bow" end rather than by the "stern." FIG. 5 illustrates ship 10 with a tow line 510 connected to its stern 16 and connected to that portion of decoy 400 adjacent to reflector cluster 401*d*, corresponding to the "bow" of the decoy 400, as established by the distribution of reflectors of various amplitudes.

While the separators for the return signal generators or the reflector clusters have been described as nominally rigid, they may be rigid.

A ship (10) decoy (400) according to an aspect of the disclosure comprises a plurality of radar return generators (of set 401), each of which radar return generators (of set 401) is structurally attached to the next with a nominally fixed separation by a nominally rigid member (of set 411). The radar return generators (of set 401) may be an active radar repeating device or passive radar reflector, and such a passive device may include a plurality of trihedral corner reflectors, which may be subsumed within an inflatable icosahedral structure (FIG. 2). The nominally rigid member (of set 411) may comprise an inflatable tube (311, 312) affixed to each of the radar return generators (of set 401) and extending to the next adjacent radar return generator (of set 401) to thereby define a string (400) of radar return generators (of set 401). The decoy (400) may be used with a ship (10) having a particular spatial distribution (21) of significant radar scattering locations or hot spots along its length, wherein the location in the decoy (400) of each one of the radar return generators (of set 401) corresponds to the relative position of one of the significant scattering locations (21), and the fixed separation between each of the return generators (of set 401) and the next corresponds to the separation (D1, D2, . . . ) between the corresponding ones of the scattering locations (21). Each radar return generator (of set 401) may exhibit amplitude relative to others of the radar return generators (of set 401), which amplitude corresponds with the relative amplitude of corresponding ones of the significant scattering locations (21) of the ship (10). In a particularly advantageous embodiment, a decoy (400) for use with a ship (10) having a particular amplitude distribution of significant radar scattering locations (21) along its length, has location and reflection amplitude of each one of the radar return generators (of set 401) corresponding to the relative position and amplitude of one of the significant radar scattering locations (of locations 21), and the fixed separation between each of the return generators (of set 401) and the next return generator corresponds to the separation between the corresponding ones of the scattering locations (of set 21) of the ship. In a particularly advantageous embodiment according to an aspect of the disclosure, the combination of the radar return generators (of set 401) and the nominally rigid member (of set 411) is lighter than water. This is easily accomplished if both the nominally rigid members (of set 411) and the radar return generators (of set 401) are both lightweight inflatable structures.

According to another aspect of the disclosure, a floating decoy (400) for a ship (10) having a particular distribution (21) of significant radar scattering locations along its length, which significant scattering locations are spaced apart by known distances (D1, D2, . . . ). The floating decoy (400) comprises a plurality of significant radar scattering devices (401). The floating decoy (400) also comprises at least one elongated, nominally rigid member (of set 411) extending between mutually adjacent ones of the radar scattering devices (401). The length of each member is selected in conjunction with the dimensions of the significant radar scattering devices such that the nominal distance between adjacent ones of the locations equals the separation between adjacent corresponding ones of the scattering locations. In a particular embodiment, the nominally rigid member (of set 411) is in the form of a tube (311, 312), and the tube (311, 312) may be an inflatable tube (311, 312). Each of the significant radar scattering devices may comprise a cluster (200) of simple radar reflectors. In a preferred embodiment, the particular distribution of significant radar scattering locations along the length of the ship (10) is accompanied by a distribution of the reflection amplitudes of the radar scattering devices (of set 401), and the spatial distribution (21) of reflection amplitudes of the radar scattering devices (of set 401) is correlated with the spatial distribution (21) of the significant radar scattering locations.

A floating decoy (400) for a ship (10) having a particular radar return distribution (401) of at least a first radar spot (24*r*), (22*r*), or (18*r*) and a second significant radar hot spot (20*r*) at locations spaced by a particular distance (e.g., D3 between radar hot spots 18*r* and 20*r* and D1 plus D2 between radar hot spots 20*r* and 24*r*) along its length, where the radar hot spots (18*r*) and (20*r*) have mutually different amplitudes. The decoy (400) comprises a radar return device of a first magnitude (401*a*), (401*b*), or (401*d*) and a radar return device of a second different magnitude (401*c*) (either greater or less than the first magnitude), with the radar return device of the first magnitude (401*a*), (401*b*), or (401*d*) exhibiting a radar return amplitude related to the amplitude of the first one of the hot spots (24*r*), (22*r*), or (18*r*) and the radar return device of the second magnitude (401*c*) exhibiting a radar return amplitude related to the amplitude of the second one of the hot spots (20*r*). The decoy also comprises at least one elongated nominally rigid member (411*a*), (411*b*), or (411*c*) extending between the radar return devices. The length of the nominally rigid member (411*a*), (411*b*) or (411*c*) is sized so that when placed between two of the radar return devices, the resulting center to center distance between the radar return devices is equal to the desired separation (D1), (D2) or (D3), in particular, the size of nominally rigid member (411*a*) can be determined by subtracting half the diameters of the radar return devices (401*a*) and (401*b*) from the desired separation (D1). The length of the nominally rigid multi-tube member (321) or (322) or (331) or (332) is sized so that when placed between two of the radar return devices, the resulting center to center distance between the return devices is equal to the desired separation (D1), (D2) or (D3), in particular, for a nominally rigid multi-tube member, the size of e.g., the nominally rigid multi-tube member (321), is determined by subtracting the linear length contribution of (401*a*) and (401*b*) from the desired separation (D1).

A decoy (400) for a ship (10) having a particular distribution of at least a first significant radar return location (24*r*) and a second (18*r*) significant radar return location spaced by a particular distance (D1 plus D2 plus D3 which is equal to the combined lengths of the nominally rigid members (411*a*), (411*b*), and (411*c*), plus the combined diametric lengths of the radar return devices (401*b*) and (401*c*) plus the combined one-half diametric lengths of the radar return devices (401*a*) and (401*d*), along its length, the radar return locations having nominally the same relative return amplitudes. The decoy (400) comprises first and second inflatable significant radar return devices (401*a*) and (401*d*), both of which exhibit the same return amplitudes. The decoy (400) also comprises at least one nominally rigid member (411*a*), (411*b*), or (411*c*) extending between the first and second radar return devices, the length of the nominally rigid member (411*a*), (411*b*), or (411*c*) and any intervening radar return devices (401*b*) and (401*c*) being nominally equal to the particular distance defined by the combined lengths of the nominally rigid members (411*a*), (411*b*), and (411*c*), plus the combined diametric lengths of the radar return devices (401*b*) and (401*c*), plus the combined one-half diametric lengths of the radar return devices (401*a*) and (401*d*).

A floating decoy (400) for seducing a radar homing missile toward the decoy (400) and away from a ship (10) to be protected, the ship (10) to be protected defining a particular distribution of at least first and second radar reflection hot spots, where the distribution of the first and second hot spots implicates both hot spot relative amplitude and hot spot relative locations along the length of the ship (10), the decoy (400) comprising:

at least first and second radar return generator (of set 401)s exhibiting a spatial and amplitude distribution corresponding to that of the first and second hot spots.

A method for using a floating decoy (400) for seducing a radar homing missile toward the decoy (400) and away from a ship (10) to be protected, where the ship (10) to be protected defines a particular amplitude and spatial distribution (21) of at least first and second radar reflection hot spots, where the first reflection hot spot is at a location more forward than the second radar reflection hot spot, where the decoy (400) comprises first and second radar return generator (of set 401)s having the particular amplitude and spatial distribution (21), the method comprising the step of:

towing the floating decoy (400) with the first radar return generator (of set 401) forward of the second radar return generator (of set 401).

What is claimed is:

1. A ship decoy for returning a radar signal, said ship decoy comprising:

a plurality of radar return generators; and a nominally rigid member attaching each one of said radar return generators with another one of said radar return generators in a nominally fixed separation, wherein said nominally fixed separations correspond to physical characteristics of a ship to be protected;

and wherein each of said radar return generators comprises:

a plurality of reflectors configured in an inflatable structure having metalized septa defining said reflectors, the flexible metalized septa having defined therein a plurality of through apertures adapted to facilitate inflation of the inflatable structure without adversely affecting reflectivity.

2. A ship decoy according to claim 1, wherein at least one of said radar return generators is an active radar repeating device.

3. A ship decoy according to claim 1, wherein at least one of said radar return generators is a passive radar reflector.

4. A ship decoy according to claim 1, wherein each of said nominally rigid members comprises an inflatable tube or two or more parallel inflatable tubes affixed to said radar return generators thereby defining a string of radar return generators.

5. A decoy according to claim 1 for use with a ship having a particular spatial distribution of significant radar scattering locations along its length, wherein the location of each one of said radar return generators corresponds to the relative position of one of said significant scattering locations, and said nominally fixed separation between said radar return generators corresponds to the separation between the corresponding ones of said scattering locations.

6. A decoy according to claim 5, wherein each of said radar return generators exhibits an amplitude relative to others of said radar return generators, where the relative radar return generators' amplitudes roughly correspond with the relative amplitude of corresponding ones of said significant scattering locations of said ship.

7. A decoy according to claim 1 for use with a ship having a particular amplitude distribution of significant radar scattering locations along its length, wherein the location and reflection amplitude of each one of said radar return generators corresponds to the relative position and amplitude of one of said significant radar scattering locations, and said nominally fixed separation between said radar return generators corresponds to the separation between the corresponding ones of said scattering locations.

8. A decoy according to claim 1, wherein the combination of said radar return generators and said nominally rigid members is lighter than water.

9. A decoy according to claim 8, wherein said radar return generators are lighter than water.

10. The ship decoy of claim 1, wherein a first nominally fixed separation corresponds to a separation between a deckhouse and a mast associated with the ship to be protected.

11. The ship decoy of claim 1, wherein a first nominally fixed separation corresponds to a separation between a mast and a gun associated with the ship to be protected.

12. The ship decoy of claim 1, wherein a first nominally fixed separation corresponds to a separation between a superstructure and a gun associated with the ship to be protected.

13. The ship decoy of claim 1, wherein each through aperture of the plurality of flexible metalized septa has a circumference of less than about 1/10 wavelength of the radar signal.

14. The ship decoy of claim 1, wherein each of said radar return generators is configured in the shape of a sphere.

15. A decoy for a ship having a particular distribution of significant radar scattering locations along its length for scattering a radar signal, which significant scattering locations are spaced apart by known distances, said decoy comprising:

a plurality of significant radar scattering devices; and at least one elongated, nominally rigid member extending between mutually adjacent ones of said radar scattering devices, the length of said member being selected in conjunction with the dimensions of said significant radar scattering devices such that the nominal distance between adjacent ones of said radar scattering devices equals the separation between adjacent corresponding ones of said scattering locations; and wherein each of said significant radar scattering devices comprises:

a cluster of trihedral corner reflectors configured in an inflatable icosahedral structure having a plurality of flexible metalized septa defining said trihedral corner reflectors, the flexible metalized septa having defined therein a plurality of through apertures of circumference sized less than about 1/10 wavelength of the radar signal to facilitate inflation of the inflatable structure without adversely affecting reflection of said trihedral corner reflectors.

16. A decoy according to claim 15, wherein said nominally rigid member is in the form of a tube.

17. A decoy according to claim 16, wherein said tube is an inflatable tube.

18. A decoy according to claim 15, wherein each of said significant radar scattering devices comprises a cluster of simple radar reflectors.

19. A decoy according to claim 15, wherein said particular distribution of significant radar scattering locations along the length of said ship is accompanied by a distribution of the reflection amplitudes of said radar scattering devices, and the spatial distribution of reflection amplitudes of said radar scattering devices is correlated with the spatial distribution of said significant radar scattering locations.

20. A decoy for a ship having a particular distribution of at least first and second significant radar hot spots at locations spaced by a particular distance along its length, said hot spots having mutually different amplitudes, said decoy comprising:

first and second radar return devices implemented as a flexible material structure in the general shape of a sphere with internal metalized septa having defined therein a plurality of through apertures adapted to facilitate inflation of the sphere, said first radar return device exhibiting a radar return amplitude related to the amplitude of said first one of said hot spots and said second radar return device exhibiting a radar return amplitude related to the amplitude of said second one of said hot spots;

at least one elongated nominally rigid member extending between said first and second radar return devices, the length of said nominally rigid member and any combination of intervening radar return devices and members being equal to said particular distance.

21. The decoy of claim 20, wherein said first and second radar return devices are connected by two elongated nominally rigid members extending parallel between the first and second radar return devices.

22. A decoy for seducing a radar homing missile toward the decoy and away from a ship to be protected, said ship to be protected defining a particular distribution of at least first and second radar reflection hot spots, where said distribution of said first and second hot spots implicates both hot spot relative amplitude and hot spot relative locations defining a distance along the length of the ship, said decoy comprising:

at least first and second radar return generators implemented as a flexible material structure in the general shape of a sphere with internal metalized septa having defined therein a plurality of through apertures adapted to facilitate inflation of the sphere, and exhibiting a spatial distribution equal to the distance between said hot spot relative locations and equal to said hot spot relative amplitude distribution corresponding to that of said first and second hot spots.

23. The decoy of claim 22, wherein said first and second radar return generators are connected by two elongated nominally rigid members extending parallel between the first and second radar return generators.

24. A method for seducing a radar homing missile away from a ship to be protected, where said ship to be protected defines a particular amplitude and spatial distribution of at least first and second radar reflection hot spots, where said first reflection hot spot is at a location more forward than said second radar reflection hot spot, said method comprising the step of:

providing a floating decoy of first and second radar return generators implemented as a flexible material structure in the general shape of a sphere with internal metalized septa having defined therein a plurality of through apertures adapted to facilitate inflation of the sphere, and having said particular amplitude and spatial distribution, wherein said spatial distribution is defined by a distance between said first and second radar return generators that is equal to a distance between said first an second reflection hot spots; and towing said floating decoy with said first radar return generator forward of said second radar return generator.

25. The method of claim 24, further comprising:

providing first and second nominally rigid members running parallel to each other between said first and second radar return generators; and connecting said first and second radar return generators to ends of said first and second nominally rigid members at said distance that is equal to the distance between said first and second reflection hot spots.

26. A method for seducing a missile having a radar seeker away from a ship having a plurality of significant scattering locations along its length, said method comprising the steps of;

providing a plurality of lighter-than-water radar return generators wherein each generator comprises a cluster of radar reflectors subsumed in an inflatable structure and defined by flexible metalized septa having through apertures defined therein;

attaching a tether connecting each of said generators to the next, thereby defining a string of generators having first and second ends, with the lengths of said tethers being selected to space said generators at distances which substantially correspond with the distance between corresponding scatterer locations of said ship;

placing said generators and said tether in an aqueous environment;

inflating said inflatable structure including passing gas through the through apertures of said metalized septa; and towing one of said first and second ends of said string, whereby drag resulting from said towing in said aqueous environment causes said generators to assume separations established by the lengths of the generator-to-generator tethers.

27. The method of claim 26, further comprising the step of forming said through apertures in said flexible metalized septa to a circumference of less than about 1/10 wavelength of a radar signal of the seeker.

28. A ship decoy comprising:

a plurality of radar return generators implemented as a flexible material structure in the general shape of a sphere with internal metalized septa having defined therein a plurality of through apertures adapted to facilitate inflation of the sphere; and a nominally rigid member attaching each one of said radar return generators with another one of said radar return generators in a nominally fixed separation, wherein said nominally fixed separations define a generator distance between a first and second radar return generator, said generator distance equal to a physical distance observed between a first physical characteristic and a second physical characteristic of a ship to be protected;

wherein each said radar return generator is an active radar repeating device comprising:

clusters of active components; and at least one power supply for providing power to each active component.

* * * * *